US008399396B2

(12) United States Patent
Gardner et al.

(10) Patent No.: US 8,399,396 B2
(45) Date of Patent: Mar. 19, 2013

(54) TIRON-CONTAINING DETERGENTS HAVING ACCEPTABLE COLOR

(75) Inventors: Robb Richard Gardner, Cincinnati, OH (US); Allison Lynn Gerdes, Mason, OH (US); Jeffrey Anderson Seeley, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 12/317,574

(22) Filed: Dec. 23, 2008

(65) Prior Publication Data

US 2009/0176684 A1 Jul. 9, 2009

Related U.S. Application Data

(60) Provisional application No. 61/010,260, filed on Jan. 7, 2008.

(51) Int. Cl.
*C11D 3/30* (2006.01)
*C11D 1/12* (2006.01)

(52) U.S. Cl. ..... 510/498; 510/276; 510/300; 510/345; 510/392; 510/480

(58) Field of Classification Search ..... 510/276, 510/300, 345, 392, 480, 498
See application file for complete search history.

(56) References Cited

U.S. PATENT DOCUMENTS

| | | | | |
|---|---|---|---|---|
| 3,864,286 | A | 2/1975 | Anderson | |
| 4,264,716 | A * | 4/1981 | Vincent et al. | 430/380 |
| 4,687,592 | A | 8/1987 | Collins et al. | |
| 5,821,037 | A * | 10/1998 | Twist et al. | 430/373 |
| 5,885,362 | A | 3/1999 | Morinaga et al. | |
| 6,071,683 | A * | 6/2000 | Goddard et al. | 430/557 |
| 6,127,107 | A * | 10/2000 | Codling et al. | 430/543 |
| 6,525,013 | B1 * | 2/2003 | Littig et al. | 510/322 |
| 6,559,243 | B1 * | 5/2003 | Heinzman et al. | 525/398 |
| 2005/0153869 | A1 * | 7/2005 | Connor et al. | 510/515 |
| 2006/0035177 | A1 * | 2/2006 | Haye et al. | 430/467 |
| 2008/0009431 | A1 * | 1/2008 | Boutique et al. | 510/393 |
| 2008/0015135 | A1 * | 1/2008 | de Buzzaccarini et al. | 510/336 |
| 2008/0113305 | A1 * | 5/2008 | Yoneyama et al. | 430/558 |
| 2009/0105109 | A1 * | 4/2009 | Lant et al. | 510/320 |

FOREIGN PATENT DOCUMENTS

| | | |
|---|---|---|
| WO | WO 2006/133773 | 12/2006 |
| WO | WO 2006/133790 | 12/2006 |
| WO | WO 2008/101909 | 8/2008 |

OTHER PUBLICATIONS

PCT International Search Report, dated Apr. 1, 2009, 15 pages.

* cited by examiner

*Primary Examiner* — Charles Boyer

(74) *Attorney, Agent, or Firm* — Melissa G. Krasovec; Steven W. Miller

(57) ABSTRACT

Detergent compositions containing catechols, such as Tiron (1,2-dihydroxybenzene-3,5-disulfonic acid), which do not have or do not develop the reddish color associated with the catechol/ferric iron chelate are disclosed. Methods for reducing the intensity of red color in a Tiron (1,2-dihydroxybenzene-3,5-disulfonic acid) containing detergent composition are also disclosed.

13 Claims, 2 Drawing Sheets
(2 of 2 Drawing Sheet(s) Filed in Color)

* Calcium formate levels constant at 0.075

TIRON-CONTAINING DETERGENTS HAVING ACCEPTABLE COLOR

CROSS REFERENCE TO RELATED APPLICATIONS

This application claims priority under 35 U.S.C. §119(e) to U.S. Provisional Application Ser. No. 61/010,260 filed Jan. 7, 2008, incorporated by reference herein.

FIELD OF THE INVENTION

This disclosure relates to detergent compositions containing Tiron (1,2-dihydroxybenzye-3,5-disulfonic acid) which do not have the reddish color associated with the Tiron (1,2-dihydroxybenzye-3,5-disulfonic acid)/ferric iron chelate.

BACKGROUND OF THE INVENTION

Catechols are defined as members of a family of aromatic diols having a substituted 1,2-benzenediol skeleton. Tiron, also known as 1,2-dihydroxybenzene-3,5-disulfonic acid, is one member of the catechol family and has the molecular structure shown in Scheme 1. Other sulphonated catechols also exist. In addition to the disulfonic acid, the term "Tiron (1,2-dihydroxybenzye-3,5-disulfonic acid)" may also include mono- or di-sulfonate salts of the acid, such as, for example, the disodium sulfonate salt.

Scheme 1

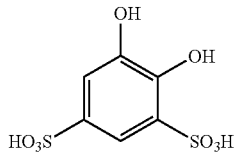

Tiron

Tiron (1,2-dihydroxybenzye-3,5-disulfonic acid) and other catechols bind to ions of certain transition metals, such as ions of iron and titanium, and form colored metal/chelant complex. For example, in solutions Tiron (1,2-dihydroxybenzye-3,5-disulfonic acid)binds to ferric iron ($Fe^{3+}$) to form a burgundy red metal/Tiron (1,2-dihydroxybenzye-3,5-disulfonic acid) complex. The presence of this colored $Fe^{3+}$/Tiron (1,2-dihydroxybenzye-3,5-disulfonic acid) species may be detected at metal ion concentrations of 0.1 parts per million (ppm) or even lower. Thus, Tiron (1,2-dihydroxybenzye-3,5-disulfonic acid) has traditionally been used as a colorimetric indicator/chelant for the presence of titanium or iron.

Catechols, such as Tiron (1,2-dihydroxybenzye-3,5-disulfonic acid), are also small molecule chelants that may be used as cleaning agents. For example, Tiron (1,2-dihydroxybenzye-3,5-disulfonic acid) delivers robust hydrophilic cleaning benefits and may also drive particulate cleaning via clay peptization, suspension, and/or synergy with polymeric dispersing systems. In addition, Tiron (1,2-dihydroxybenzye-3,5-disulfonic acid) may be compatible with certain enzymatic cleaning agents used in certain detergent compositions.

However, many detergent compositions contain low concentrations of soluble iron, such as ferric iron. The concentration of ferric iron in these detergents is enough to form sufficient metal/chelant complexes with certain catechols, such as Tiron (1,2-dihydroxybenzye-3,5-disulfonic acid), to give the detergent an undesirable reddish color. This is particularly true for liquid detergent compositions in which the soluble ferric iron may freely complex with the Tiron (1,2-dihydroxybenzye-3,5-disulfonic acid) in the liquid detergent. For example, addition of low levels of Tiron (1,2-dihydroxybenzye-3,5-disulfonic acid) to commercially available detergents results in the detergent acquiring a reddish hue associated with the formation of the iron/Tiron (1,2-dihydroxybenzye-3,5-disulfonic acid) complex.

Many consumers may disfavor reddish colored detergents. For example, a reddish color in detergent may be associated with rust. Thus, in order to produce detergent compositions within the blue color space, many detergent producers specifically avoid red chromophores. The presence of red chromophores in a detergent formulation may result in additional cost required to remove the red color from the detergent. Since detergents comprising certain catechols, such as Tiron (1,2-dihydroxybenzye-3,5-disulfonic acid), would result in a reddish hue to the detergent composition due to the presence of ferric iron, many catechols, including Tiron (1,2-dihydroxybenzye-3,5-disulfonic acid), have not traditionally been used in detergent applications, particularly in liquid detergents.

It would be desirable to produce a detergent possessing the cleaning benefits associated with Tiron (1,2-dihydroxybenzye-3,5-disulfonic acid) without the concomitant formation of the reddish iron/chelate complex.

SUMMARY OF THE INVENTION

Embodiments of the present disclosure generally relate to detergent compositions comprising Tiron (1,2-dihydroxybenzye-3,5-disulfonic acid) with an acceptable color level.

In one embodiment, the present disclosure provides a detergent composition. The detergent composition comprises Tiron (1,2-dihydroxybenzye-3,5-disulfonic acid) and a ligand capable of chelating to ferric iron. The ferric iron and the ligand may form a complex, wherein the complex does not have a red color.

In another embodiment, the present disclosure provides a detergent composition comprising Tiron (1,2-dihydroxybenzye-3,5-disulfonic acid), diethylenetriaminepentaacetic acid ("DTPA"), a calcium salt, and ferric iron. According to certain embodiments, substantially all of the ferric iron is complexed to the DTPA.

In a further embodiment, the present disclosure provides for a method of reducing the intensity of a red color in a Tiron (1,2-dihydroxybenzye-3,5-disulfonic acid) containing detergent composition. The method comprises adding a ligand capable of chelating to the ferric iron present in the detergent composition. According to specific embodiments, the ligand is DTPA and chelates substantially all of the ferric iron in the detergent composition.

BRIEF DESCRIPTION OF THE DRAWINGS

The patent or application file contains at least one drawing executed in color. Copies of this patent or patent application publication with color drawings will be provided by the Office upon request and payment of the necessary fee.

The various embodiments set forth in the Description of the Invention will be better understood with reference to the following drawings, wherein.

DETAILED DESCRIPTION OF THE INVENTION

A. Definitions

Figure 1:
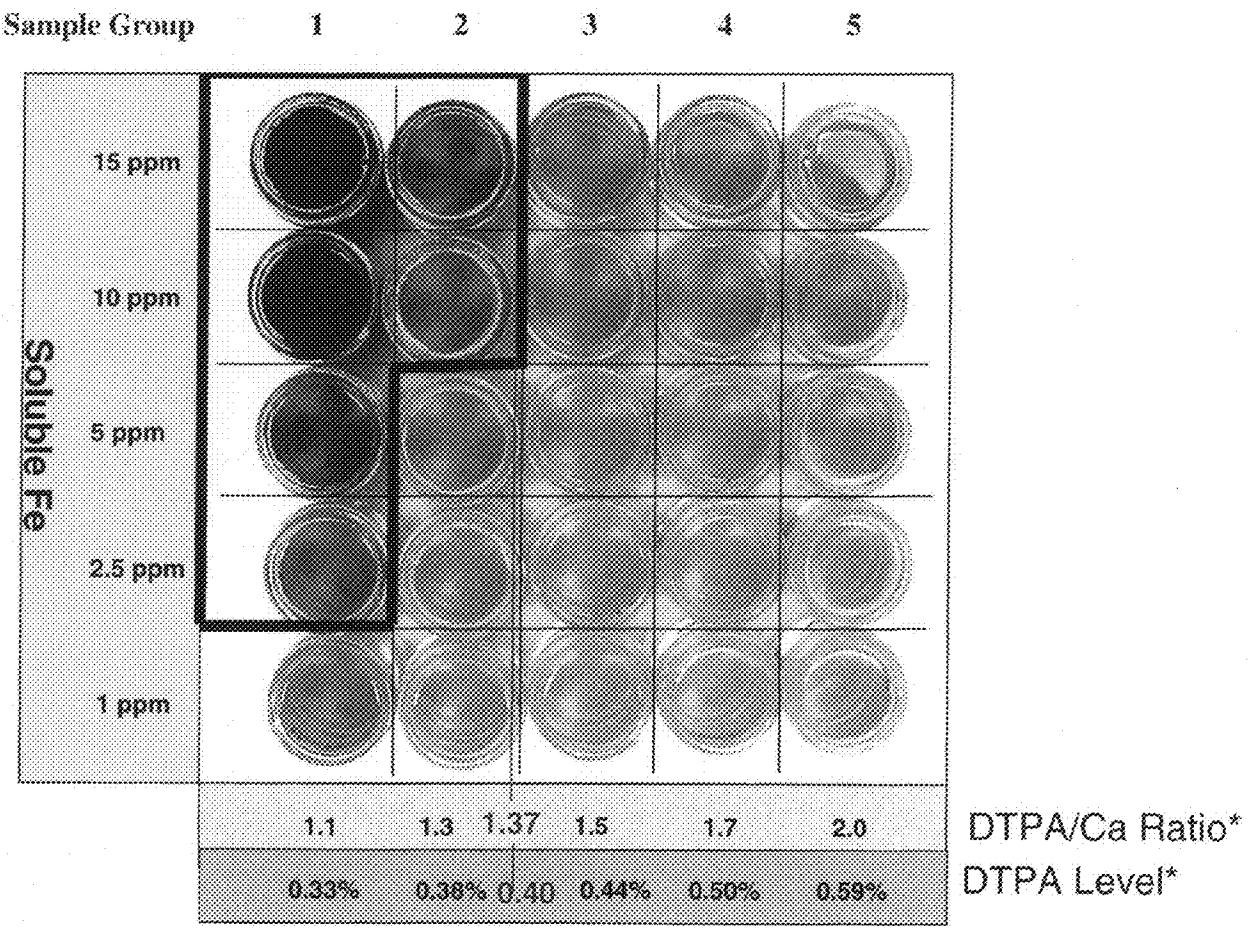
FIG. 1 illustrates the color formation from the iron/Tiron (1,2-dihydroxybenzye-3,5-disulfonic acid) complex at various levels of iron and ligand in a 5×5 sample matrix.

As used herein, the term "comprising" means various components conjointly employed in the preparation of the compositions of the present disclosure. Accordingly, the terms "consisting essentially of" and "consisting of" are embodied in the term "comprising".

As used herein, the term "catechol" includes substituted and unsubstituted 1,2-dihydroxybenzenes.

As used herein, the term "Tiron (1,2-dihydroxybenzye-3,5-disulfonic acid)" includes 1,2-dihydroxybenzene-3,5-disulfonic acid and mono- and di-sulfonate salts thereof.

As used herein, the term "ferric iron/ligand complex" or "metal/ligand complex" means the complex formed when a metal ion (such as ferric iron) bonds to a ligand via an ionic, covalent, or coordinate covalent bond.

As used herein, the term "binding constant" is a measurement of the equilibrium state of binding, such as binding between a metal ion and a ligand to form a complex. In certain cases, the binding constant $K_{bc}$ may be calculated using the following equation:

$$K_{bc}=[ML_x]/([M][L]^x)$$

where [L] is the concentration of ligand, x is the number of ligands that bond to the metal, [M] is the concentration of metal ion, and [MLx] is the concentration of the metal/ligand complex.

B. Process and Composition

Catechols, such as Tiron (1,2-dihydroxybenzye-3,5-disulfonic acid), form colored metal/ligand complex with iron, such as ferric ion ($Fe^{3+}$), which may be visible at even low concentrations of metal ion. For example, complexation of Tiron (1,2-dihydroxybenzye-3,5-disulfonic acid) with ferric iron may be represented by equation (1) in which the burgundy red-colored Fe(Tiron (1,2-dihydroxybenzye-3,5-disulfonic acid)$_3$ metal/ligand complex is formed in solution. Fe(Tiron (1,2-dihydroxybenzye-3,5-disulfonic acid)$_3$ displays an absorption maximum at 476 nm within the electromagnetic spectrum with a strong extinction coefficient. The red-colored Fe(Tiron (1,2-dihydroxybenzye-3,5-disulfonic acid)$_3$ metal/ligand complex may be visible at ferric iron concentrations of 0.1 ppm or lower. Thus, catechols, such as Tiron (1,2-dihydroxybenzye-3,5-disulfonic acid) have been used as a colorimetric indicator for the presence of transition metals, such as iron and titanium, in solutions.

$$Fe^{3+}+3\text{Tiron(1,2-dihydroxybenzye-3,5-disulfonic acid)}\rightarrow Fe(\text{Tiron(1,2-dihydroxybenzye-3,5-disulfonic acid)}_3 \quad (1)$$

Catechols, such as Tiron (1,2-dihydroxybenzye-3,5-disulfonic acid), are also small molecule chelants that may deliver a robust hydrophilic cleaning benefit. In addition, catechols, such as Tiron (1,2-dihydroxybenzye-3,5-disulfonic acid), may drive particulate cleaning via, for example, clay peptization, suspension, and/or synergy with polymeric dispersing systems. The cleansing benefits derived from catechols may go beyond what is typically possible with conventional chelant technologies. For example, catechols such as Tiron (1,2-dihydroxybenzye-3,5-disulfonic acid) may be compatible with certain enzymes used in detergent formulations, including, calcium-dependent enzymes. Thus, the combination of these and other benefits make catechols, including, for example, Tiron (1,2-dihydroxybenzye-3,5-disulfonic acid), an attractive cleaning technology for heavy duty liquid ("HDL") detergents.

However, the presence of soluble iron, such as ferric iron, in HDL detergents may result in an undesired red colored chromophore associated with an iron/catechol complex when certain catechols, such as Tiron (1,2-dihydroxybenzye-3,5-disulfonic acid), are added as a component of these detergents. Many commercially available detergents have residual ferric iron levels sufficient to form an observable reddish color upon the addition of low levels of Tiron (1,2-dihydroxybenzye-3,5-disulfonic acid). For example, the iron levels of a collection of "off-the-shelf" samples of HDL detergent samples were measured. Commercially available HDL detergents (24 samples) showed an average total Fe concentration of 0.6-0.7±0.2 ppm. These iron levels are sufficient to promote formation of the colored complex upon addition of Tiron (1,2-dihydroxybenzye-3,5-disulfonic acid) to the HDL. Therefore, the addition of a catechol, such as Tiron (1,2-dihydroxybenzye-3,5-disulfonic acid), to HDL detergent compositions may result in the detergent composition developing an undesired red or reddish color.

As discussed herein, consumers of detergents compositions do not prefer red or reddish color in their detergent products. For example, the red color may be associated with rust or other staining impurities. The presence of minute concentrations of soluble iron along with the added Tiron (1,2-dihydroxybenzye-3,5-disulfonic acid) in these HDL detergents results in a burgundy-red complex (Fe(Tiron (1,2-dihydroxybenzye-3,5-disulfonic acid)$_3$) in laboratory, commercial, or plant samples. This resulting red color may prevent the current dye systems utilized in these detergents from attaining a consumer preferred product color. Thus, the incorporation of Tiron (1,2-dihydroxybenzye-3,5-disulfonic acid) into detergent compositions would necessarily require removal of the red chromophore and/or elimination of iron from the composition for optimal economic benefit and consumer preference.

The present disclosure is directed to the development of detergent compositions comprising catechols, such as Tiron (1,2-dihydroxybenzye-3,5-disulfonic acid) which do not develop a visible or significant red or reddish color due to metal/ligand complex formation between the catechol ligand and residual soluble iron, such as ferric iron, in the detergent. Inhibiting the formation of iron/Tiron (1,2-dihydroxybenzye-3,5-disulfonic acid) complexes, and the concomitant red coloration, allows the incorporation of Tiron (1,2-dihydroxybenzye-3,5-disulfonic acid) into detergent compositions, such as HDL detergents. One approach according to certain embodiments of the present disclosure includes adding a compound capable of preferentially bonding to or complexing with the ferric iron in the detergent to form a non-colored complex or a complex having a color that is compatible with the detergent system and/or consumer preferences, thereby preventing the ferric iron from forming the colored iron/Tiron (1,2-dihydroxybenzye-3,5-disulfonic acid) complex. Examples of compounds capable of bonding to or complexing with the ferric iron include chelating ligands which form chelates with the ferric iron and can out compete Tiron (1,2-dihydroxybenzye-3,5-disulfonic acid) for soluble iron in the high ionic strength environment of an HDL detergent. It should be noted that while certain embodiments herein describe the use of the catechol Tiron (1,2-dihydroxybenzye-3,5-disulfonic acid), other catechols, such as, but not limited to, other catechol disulfonic acids, catechol monosulfonic acids and there acid salts, may possibly be substituted for Tiron (1,2-dihydroxybenzye-3,5-disulfonic acid) in various embodiments.

According to one embodiment, the present disclosure relates to a detergent composition comprising Tiron (1,2-dihydroxybenzye-3,5-disulfonic acid) and a ligand capable of chelating to ferric iron in the detergent, wherein a complex formed between the ligand and Tiron (1,2-dihydroxybenzye-3,5-disulfonic acid) does not have a red color. According to this embodiment, the ligand capable of chelating to ferric iron in the detergent may preferentially binds with and ligate to with the soluble ferric iron in the detergent, thereby reducing the concentration of the soluble ferric iron from the detergent composition. As the soluble ferric iron binds to the ligand capable of chelating to ferric iron, the ferric iron is unavailable to bind with the Tiron (1,2-dihydroxybenzye-3,5-disulfonic acid) and thereby form the red colored iron/Tiron (1,2-dihydroxybenzye-3,5-disulfonic acid) complex. According to certain embodiments, substantially all of the ferric iron in the detergent composition is in the form of a ferric iron/ligand complex. As used herein, the term "substantially all" when used in conjunction with ferric iron concentration, means less than 0.3 ppm and in certain embodiments less than 0.1 ppm of the ferric iron is not in the form of the ferric iron/ligand complex.

In certain embodiments, the ligand capable of chelating to ferric iron has a binding constant for ferric iron of at least $10^{21}$. As defined herein, the binding constant is a measure of the equilibrium state of binding, such as binding between a ferric iron ion and a ligand to form a complex. For example, the binding constant of $Fe^{3+}$ to Tiron (1,2-dihydroxybenzye-3,5-disulfonic acid) is reported to be about $10^{20.3}$ according to the National Institute of Standards and Technology ("NIST"), R. M. Smith, and A. E. Martell, NIST Standard Reference Database 46, NIST Critically Selected Stability Constants of Metal Complexes Version 8.0, May 2004, U.S. Department of Commerce, Technology Administration, NIST, Standard Reference Data Program, Gaithersburg, Md. Therefore, a ligand with a binding constant for ferric iron of at least $10^{21}$ will bind preferentially to the ferric iron over Tiron (1,2-dihydroxybenzye-3,5-disulfonic acid). In certain embodiments, the ligand may have a binding constant for ferric iron ranging from about $10^{26}$ to about $10^{30}$.

In various embodiments, the ligand capable of chelating to ferric iron may be selected from the group consisting of diethylenetriaminepentaacetic acid ("DTPA"), diethylenetriamine-pentamethylphosphonic acid ("DTPMP"), and combinations thereof. Other suitable ligands capable of chelating to ferric iron are disclosed in A. E. Martell, R. D. Hancock, "Metal Complexes in Aqueous Solutions" in Modern Inorganic Chemistry, Plenum Press, New York, N.Y., 1996, pp 58-197 and specifically at pp 151-158. The ligands recited herein include the free acid ligand and the various acid salts, such as the mono-, di-, tri-, tetra- and pentaacetate salts (including the alkali metal salts) and the mono-, di-, tri-, tetra- and pentaphosphonate salts. In one embodiment, the ligand is DTPA including the pentasodium acetate salt. In other embodiments, the ligand may be DTPMP. For example, in certain countries, phosphate content in detergent compositions may be restricted. In such counties, such as the United States of America, phosphate free ligands, such as DTPA, may serve as a ligand. In other countries where phosphate content in detergent compositions is not strictly regulated, phosphorus containing ligands, such as DTPMP, may be used as an alternative to DTPA or as a mixture with DTPA. The binding constant for DTPA with ferric iron is about $10^{27.7}$, whereas the binding constant for DTPMP with ferric iron is greater than $10^{28}$. Ferric iron will bind preferentially to the ligand, for example, DTPA or DTPMP, over Tiron (1,2-dihydroxybenzye-3,5-disulfonic acid) and therefore not form noticeable concentrations of the colored metal/Tiron (1,2-dihydroxybenzye-3,5-disulfonic acid) complex in the detergent composition. DTPA may also provide hydrophilic cleaning benefits when added to certain HDL detergent compositions. In certain embodiments, the concentration of ligand, such as DTPA and/or DTPMP, in the detergent composition may range from about 0.05% by weight to about 2.0% by weight. In other embodiments, the ligand concentration in the detergent composition may range from about 0.10% by weight to about 1.0% by weight and in still other embodiments the ligand concentration may range about 0.10% by weight to about 0.50% by weight.

According to certain embodiments, the detergent composition may further comprise at least one calcium salt. Examples of calcium salts suitable for use in the present detergent compositions include water soluble salts of $Ca^{2+}$ ions, such as, for example, calcium formate, calcium chloride, calcium bromide, calcium iodide, calcium sulfide, calcium nitrate, calcium acetate, and combinations of any thereof. In certain embodiments, the calcium salt may be calcium formate. In certain formulations, calcium ions ($Ca^{2+}$) may act to stabilize certain enzymatic components in a detergent composition. For example, NATALASE® (commercially available from Novozymes A/S Corp., Denmark), is an alpha amylase enzyme that may be used in certain HDL detergent compositions, for example for the removal of certain starch based stains. Other enzymes commonly added to HDL detergent compositions include, for example, proteases (such as Alcalase, Esperase, Savinase and Maxatase), amylases (such as Termamyl), lipases, oxidases, oxygenases, peroxidases, cellulases, hemicellulases, xylanases, phospholipases, esterases, cutinases, pectinases, keratanases, reductases, oxidases, phenoloxidases, lipoxygenases, lignin-ases, pullulanases, tannases, pentosanases, malanases, b-glucanases, arabinosidases, hyaluronidases, chondroitinases, laccases, and mixtures of any thereof. Calcium ions ($Ca^{2+}$) may act to stabilize certain amylases (such as, but not limited to NATALASE®) or certain other enzymes in detergent compositions and therefore, certain concentrations of calcium ions may be necessary for effective enzymatic cleaning activity in detergent compositions which comprise enzymes. Thus, while the ligand in the detergent composition must be capable of effectively binding to the soluble iron, such as $Fe^{3+}$ in the detergent; in enzyme containing detergents, the ligands binding to other metal ions in the detergent must also be considered. Therefore, according to certain embodiments the ligand must not only be capable of forming a chelate with soluble $Fe^{3+}$ ions, but binding of the compound to other ions such as $Ca^{2+}$, must be sufficiently low so not to mitigate the stabilizing effect of the other ion on detergent enzymes.

According to certain embodiments of the detergent composition comprising at least one calcium salt, the calcium salt may be present in an amount sufficient to provide from 0.1 ppm to 500 ppm of free $Ca^{2+}$ ion. In specific embodiments, the detergent composition may comprise sufficient calcium salts to have a free calcium ion concentration ranging between 100 ppm and 400 ppm. For example, in one embodiment where the calcium salt is calcium formate, the concentration of calcium formate in the detergent composition may range from about 0.04% to about 1.60% (w/w) of calcium formate. The value of calcium formate equals from about 0.01 to about 0.4% (w/w) of calcium ion, which corresponds to about 100 ppm to about 400 ppm.

Figure 2:
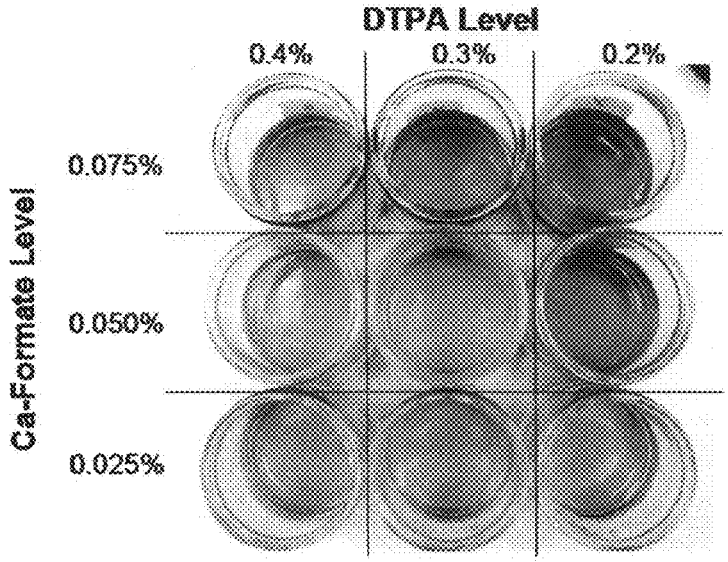
FIG. 2 illustrates the impact of ligand/calcium ratio on the color/complex formation in detergent in a 3×3 sample matrix.
Figure 3:
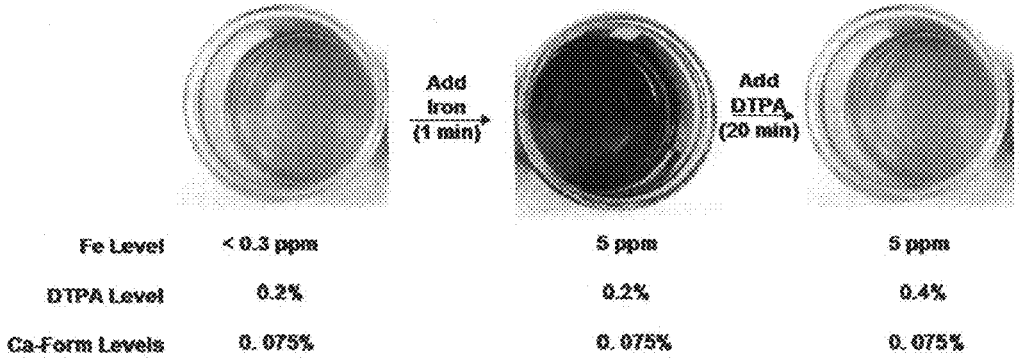
FIG. 3 illustrates the reversible formation of iron/Tiron (1,2-dihydroxybenzye-3,5-disulfonic acid) complex with the addition of a ligand.

In certain embodiments, the molar ratio of the ligand capable of chelating ferric iron compared to the calcium ion concentration may be important for maintaining acceptable color control while maintaining enzymatic stability and activity. For example, in those embodiments where the ligand is DTPA, calcium ion may mitigate the effectiveness of the DTPA color control, whereas high levels of DTPA (relative to calcium ion) may destabilize certain enzymes, such as certain amylases, for example, NATALASE®. Therefore, a specific range of molar ratios of ligand (such as DTPA) to calcium ion exists for optimum color control and enzyme activity/stability. In certain embodiments wherein the detergent composition comprises DTPA, the detergent composition has a DTPA to $Ca^{2+}$ molar ratio of at least 1.05 parts of DTPA to 1 part $Ca^{2+}$. In other embodiments, the molar ratio of DTPA to $Ca^{2+}$ may range from about 1.05:1 to about 1.8:1. In still other embodiments, the molar ratio of DTPA to $Ca^{2+}$ may range from about 1.2:1 to about 1.8:1. In still other embodiments, the molar ratio of DTPA to $Ca^{2+}$ may range from about 1.2:1 to about 1.6:1. For other detergent compositions which comprise a ligand different from DTPA, such as DTPMP, similar ligand to $Ca^{2+}$ ratios could be utilized. For example, data set forth in Table 2 demonstrates the ratio of DTPA to calcium ion may have an effect on the stability of the amylase NATALASE® in an HDL detergent. As can be seen in Table 1, enzyme stability was greatest at higher calcium ion concentrations and as the DTPA level increased, the enzyme stability decreased. FIG. 2 illustrates color formation observed at the various molar ratios measured in Table 1. FIG. 2 demonstrates that the red ferric iron/Tiron (1,2-dihydroxybenzye-3,5-disulfonic acid) chromophore is observed at DTPA:$Ca^{2+}$ molar ratios of less than 1.05:1, for example at calcium formate levels of 0.075% (w/w) and DTPA levels of 0.3% (w/w) or 0.2% (w/w) and at calcium formate levels of 0.050% (w/w) and DTPA levels of 0.2% (w/w). Table 1 and FIG. 2 illustrate that at a DTPA to calcium ion molar ratio of about 1.2:1 to about 1.6:1, a balance between good Tiron (1,2-dihydroxybenzye-3,5-disulfonic acid) color control (i.e., no noticeable red color formed from ferric iron/Tiron (1,2-dihydroxybenzye-3,5-disulfonic acid) complex formation) and good enzyme formula stability is achieved. It should be noted that for detergent compositions that do not comprise an enzyme which has variable activity according to the $Ca^{2+}$ ion concentration, the ratio of ligand to $Ca^{2+}$ concentration should not have any upper limit. That is, the upper molar ratio limit of ligand to calcium ion may be greater than 1.8:1.0. Such detergent compositions are within the scope of the present disclosure.

As discussed herein, the binding constant of Tiron (1,2-dihydroxybenzye-3,5-disulfonic acid) for $Fe^{3+}$ is $10^{20.3}$, whereas the binding constant for DTPA for $Fe^{3+}$ is $10^{27.7}$. In comparison, the binding constant of Tiron (1,2-dihydroxybenzye-3,5-disulfonic acid) for $Ca^{2+}$ is about $10^{6}$, whereas the binding constant of DTPA for $Ca^{2+}$ is about $10^{10}$. Thus, DTPA may be a suitable ligand that binds strongly to $Fe^{3+}$ ion and binds less strong to $Ca^{2+}$ ions.

According to various embodiments, the detergent compositions of the present disclosure may have a reduced red color characteristic of ferric iron/Tiron (1,2-dihydroxybenzye-3,5-disulfonic acid) chelate complex formation, for example in liquid detergents such as HDL detergents. The reduction of the red color associated with the detergent composition may be measured by any colorimetric or spectrometric method known in the art. Suitable calorimetric analytical methods include, for example, the Gardner color scale (according to American Society for Testing and Materials ("ASTM") method ASTM D1544, D6166 and/or American Oil Chemists' Society ("AOCS") method AOCS Td-1a-64); the Hunter L.a.b. (CIE) color scale (according to ASTM D5386-93b); the American Public Health Association ("APHA") color scale (according to ASTM D1209 or AOCS Td-1b-64); the Saybolt color scale (according to ASTM D156 or D6045); or the Lovibond (red) scale (according to AOCS Cc-13b-45). It should be noted that the present disclosure is not limited to any specific calorimetric measurement and the reduction of the red color observed in the various embodiments of the detergent compositions may be measured by any suitable colorimetric method.

According to certain embodiments, the reduction in the red color of detergent compositions of the present disclosure in the presence of low concentrations of ferric iron may be measured by various colorimetric methods. In various embodiments where the red color formation is measured using the Hunter L.a.b (CIE) color scale, the detergent compositions of the present disclosure in the presence of low concentrations of ferric iron may have an "L" value of greater than 85 and/or an "a" value of less than −2 and in certain embodiments will have an "a" value of less than −4. According to certain embodiments where the red color formation is measured using the Lovibond red color scale, the detergent compositions of the present disclosure in the presence of low concentrations of ferric iron may have a Lovibond red value of less than 1 and in specific embodiments the Lovibond red value may range from 0.0 to 1.0. According to other embodiments where the red color formation is measured using the APHA color scale, the detergent compositions of the present disclosure in the presence of low concentrations of ferric iron may have an APHA color value of less than 110 and in specific embodiments the APHA color value may range from about 80 to about 110. In still other embodiments where the red color formation is measured using the Saybolt color scale, the detergent compositions of the present disclosure in the presence of low concentrations of ferric iron may have a Saybolt color value of greater than 7.0 and in specific embodiments, the Saybolt color value may range from about 7.0 to about 14.0. In other embodiments where the red color formation is measured using the Gardner color scale, the detergent compositions of the present disclosure in the presence of low concentrations of ferric iron may have a Gardner color value of less than 5.0 and in specific embodiments the Gardner color value may range from about 3.0 to about 5.0. As used herein, with reference to these colorimetric methods and values, the term "low concentrations of ferric iron" includes concentrations of less than 15 ppm, in certain embodiments less than 10 ppm and in other embodiments less than 5 ppm of ferric iron in the detergent composition.

Using different calorimetric methods, such as a spectrophotometric method, the formation of red color may be measured, for example, by measuring the absorbance of a specific wavelength of light by the detergent composition/ferric iron mixture. For example, in one embodiment the absorption of light having the wavelength 540 nm may be measured and correlated to red color formation. In certain embodiments, the detergent compositions of the present disclosure in the presence of low concentrations of ferric iron may display an absorbance spectrum at 540 nm with an absorbance value of 0.8 or greater.

In other embodiments, the present disclosure provides a detergent composition comprising Tiron (1,2-dihydroxybenzye-3,5-disulfonic acid), DTPA, a calcium salt, and ferric iron. In certain embodiments, the calcium salt may be any soluble calcium salt, such as, for example, calcium formate, calcium chloride, calcium bromide, calcium iodide, calcium sulfide, calcium nitrate, calcium acetate, and combinations of any thereof.

According to other embodiments of the detergent compositions, substantially all of the ferric iron is complexed to the DTPA. As used herein, the term "substantially all" when used in reference to ferric iron concentration means that less than 0.3 ppm of ferric iron (and in certain embodiments, less than 0.1 ppm) in the composition is free or not complexed to the DTPA. That is, less than 0.3 ppm (or less than 0.1 ppm) of the ferric iron is available to complex with the Tiron (1,2-dihydroxybenzye-3,5-disulfonic acid) in the detergent composition. In other embodiments of the detergent compositions, the detergent composition has essentially no concentration of ferric iron/Tiron (1,2-dihydroxybenzye-3,5-disulfonic acid) complex. As used herein, the term "essentially no concentration" when used in reference to the concentration of the ferric iron/Tiron (1,2-dihydroxybenzye-3,5-disulfonic acid) complex means that the concentration of the ferric iron/Tiron (1,2-dihydroxybenzye-3,5-disulfonic acid) complex is less than is detectable by spectrometric or colorimetric methods, such as, for example, by measuring the transmission spectrum of the detergent composition or by utilizing any common calorimetric method such as any of those set forth herein. Thus, according to these embodiments, the detergent composition will have no red color due to the presence of the ferric iron/Tiron (1,2-dihydroxybenzye-3,5-disulfonic acid) chromophore.

In various embodiments of the detergent composition, the concentration of the calcium salt may be sufficient to provide a $Ca^{2+}$ ion concentration ranging from about 0.1 ppm to about 500 ppm of free $Ca^{2+}$ ion. In other embodiments, the concentration of the calcium salt may be sufficient to provide a $Ca^{2+}$ ion concentration ranging from about 100 ppm to about 400 ppm of free $Ca^{2+}$ ions. As discussed herein, in certain embodiments the concentration of calcium ion in the detergent composition may be important to the effectiveness of the detergent. For example, in certain cases where the detergent composition comprises an enzyme, a minimum calcium ion concentration may be necessary for optimal enzymatic activity.

In other embodiments, the molar ratio of DTPA to calcium ion may be optimized wherein both control of color formation due to the ferric iron/Tiron (1,2-dihydroxybenzye-3,5-disulfonic acid) complex and enzyme stability are maximized. According to one embodiment, the detergent composition may have a DTPA to $Ca^{2+}$ molar ratio greater than about 1.05:1. In other embodiments, the detergent compositions may have a DTPA to $Ca^{2+}$ molar ratio ranging from about 1.05:1 to about 1.8:1. In still other embodiments, the molar ratio of DTPA to $Ca^{2+}$ may range from about 1.2:1 to about 1.8:1. In still other embodiments, the molar ratio of DTPA to $Ca^{2+}$ may range from about 1.2:1 to about 1.6:1.

According to other embodiments, the detergent composition may further comprise an enzyme selected from the group consisting of proteases, amylases, hemicellulases, peroxidases, cellulases, xylanases, lipases, phospholipases, esterases, cutinases, pectinases, keratanases, reductases, oxidases, phenoloxidases, lipoxygenases, ligninases, pullulanases, tannases, pentosanases, malanases, b-glucanases, arabinosidases, hyaluronidase, chondroitinases, laccases, and combinations thereof. Examples of suitable enzymes are discussed in detail herein.

According to certain embodiments of the detergent compositions disclosed herein, the pH of the detergent composition may have an effect on color formation and/or enzyme stability. According to one embodiment, the detergent compositions may have a pH ranging from about 6 to about 10. In another embodiment, the detergent composition may have a pH ranging from about 7 to about 9. In another embodiment, the detergent composition may have a pH of about 8.

Other embodiments of the present disclosure provide for methods of reducing the intensity of a red color in a Tiron (1,2-dihydroxybenzye-3,5-disulfonic acid) containing detergent composition. As discussed herein, Tiron (1,2-dihydroxybenzye-3,5-disulfonic acid) containing detergent compositions may exhibit a red or reddish color due to the formation of the red chromophore associated with the metal ligand complex formed between Tiron (1,2-dihydroxybenzye-3,5-disulfonic acid) and soluble iron in the detergent composition. According to various embodiments, the method comprises adding a ligand capable of chelating to soluble iron, such as ferric iron, in the detergent composition. In other embodiments, the method may further comprise chelating substantially all of the soluble iron with the ligand capable of chelating the soluble iron. According to these embodiments, chelating or binding of substantially all of the soluble iron in the detergent composition with the ligand minimizes the amount of soluble iron/Tiron (1,2-dihydroxybenzye-3,5-disulfonic acid) complex formed in the detergent compositions.

Detergent Composition Components

According to certain embodiments disclosed herein, the detergent compositions of the present disclosure may further comprise certain other components known in the art. Such compositions may comprise a sufficient amount of a surfactant to provide the desired level of one or more cleaning properties, typically by weight of the total composition, from about 5% to about 90%, from about 5% to about 70% or even from about 5% to about 40% and the Tiron (1,2-dihydroxybenzye-3,5-disulfonic acid) and ligand of the present disclosure, to provide a soil and/or stain removal benefit to fabric washed in a solution containing the detergent composition. Typically, the detergent is used in the wash solution at a level of from about 0.0001% to about 0.05%, or even from about 0.001% to about 0.01% by weight of the wash solution.

The liquid detergent compositions may comprise an aqueous, non-surface active liquid carrier. Generally, the amount of the aqueous, non-surface active liquid carrier employed in the compositions herein will be effective to solubilize, suspend, or disperse the composition components. For example, the compositions may comprise, by weight, from about 5% to about 90%, from about 10% to about 70%, or even from about 20% to about 70% of an aqueous, non-surface active liquid carrier.

The most cost effective type of aqueous, non-surface active liquid carrier may be water. Accordingly, the aqueous, non-surface active liquid carrier component may be generally mostly, if not completely, water. While other types of water-miscible liquids, such alkanols, diols, other polyols, ethers, amines, and the like, have been conventionally added to liquid detergent compositions as co-solvents or stabilizers, for purposes of the present disclosure, the utilization of such water-miscible liquids may be minimized to hold down composition cost. Accordingly, the aqueous liquid carrier component of the liquid detergent products herein will generally comprise water present in concentrations ranging from about 5% to about 90%, or even from about 20% to about 70%, by weight of the composition.

The liquid detergent compositions herein may take the form of an aqueous solution or uniform dispersion or suspension of surfactant, dual character polymer, and certain optional adjunct ingredients, some of which may normally be in solid form, that have been combined with the normally liquid components of the composition, such as the liquid alcohol ethoxylate nonionic, the aqueous liquid carrier, and any other normally liquid optional ingredients. Such a solution, dispersion or suspension will be acceptably phase stable and will typically have a viscosity which ranges from about 100 to 600 cps, more preferably from about 150 to 400 cps. For purposes of this disclosure, viscosity is measured with a Brookfield LVDV-II+viscometer apparatus using a #21 spindle.

Suitable surfactants may be anionic, nonionic, cationic, zwitterionic and/or amphoteric surfactants. In one aspect, the detergent composition comprises anionic surfactant, nonionic surfactant, or mixtures thereof.

Suitable anionic surfactants may be any of the conventional anionic surfactant types typically used in liquid detergent products. Such surfactants include the alkyl benzene sulfonic acids and their salts as well as alkoxylated or non-alkoxylated alkyl sulfate materials. Exemplary anionic surfactants are the alkali metal salts of $C_{10}$-$C_{16}$ alkyl benzene sulfonic acids, preferably $C_{11}$-$C_{14}$ alkyl benzene sulfonic acids. In one aspect, the alkyl group is linear. Such linear alkyl benzene sulfonates are known as "LAS". Such surfactants and their preparation are described for example in U.S. Pat. Nos. 2,220,099 and 2,477,383. Especially preferred are the sodium and potassium linear straight chain alkylbenzene sulfonates in which the average number of carbon atoms in the alkyl group is from about 11 to 14. Sodium $C_{11}$-$C_{14}$ LAS, e.g., $C_{12}$ LAS, are a specific example of such surfactants.

Another exemplary type of anionic surfactant comprises ethoxylated alkyl sulfate surfactants. Such materials, also known as alkyl ether sulfates or alkyl polyethoxylate sulfates, are those which correspond to the formula: R'—O—$(C_2H_4O)_n$—$SO_3M$ wherein R' is a $C_8$-$C_{20}$ alkyl group, n is from about 1 to 20, and M is a salt-forming cation. In a specific embodiment, R' is $C_{10}$-$C_{18}$ is alkyl, n is from about 1 to 15, and M is sodium, potassium, ammonium, alkylammonium, or alkanolammonium. In more specific embodiments, R' is a $C_{12}$-$C_{16}$, n is from about 1 to 6 and M is sodium.

The alkyl ether sulfates will generally be used in the form of mixtures comprising varying R' chain lengths and varying degrees of ethoxylation. Frequently such mixtures will inevitably also contain some non-ethoxylated alkyl sulfate materials, i.e., surfactants of the above ethoxylated alkyl sulfate formula wherein n=0. Non-ethoxylated alkyl sulfates may also be added separately to the compositions of this invention and used as or in any anionic surfactant component which may be present. Specific examples of non-alkoyxylated, e.g., non-ethoxylated, alkyl ether sulfate surfactants are those produced by the sulfation of higher $C_8$-$C_{20}$ fatty alcohols. Conventional primary alkyl sulfate surfactants have the general formula: $ROSO_3^-M^+$ wherein R is typically a $C_8$-$C_{20}$ alkyl group, which may be straight chain or branched chain, and M is a water-solubilizing cation. In specific embodiments, R is a $C_{10}$-$C_{15}$ alkyl group, and M is alkali metal, more specifically R is $C_{12}$-$C_{14}$ alkyl and M is sodium.

Specific, non-limiting examples of anionic surfactants useful herein include: a) $C_{11}$-$C_{18}$ alkyl benzene sulfonates (LAS); b) $C_{10}$-$C_{20}$ primary, branched-chain and random alkyl sulfates (AS); c) $C_{10}$-$C_{18}$ secondary (2,3)-alkyl sulfates having formulae (I) and (II):

$$CH_3(CH_2)_x(\overset{\overset{\displaystyle OSO_3^-M^+}{|}}{C}H)CH_3 \quad \text{or} \tag{I}$$

-continued $$CH_3(CH_2)_y(\overset{\overset{\displaystyle OSO_3^-M^+}{|}}{C}H)CH_2CH_3 \tag{II}$$

wherein M in formulae (I) and (II) is hydrogen or a cation which provides charge neutrality, and all M units, whether associated with a surfactant or adjunct ingredient, can either be a hydrogen atom or a cation depending upon the form isolated by the artisan or the relative pH of the system wherein the compound is used, with non-limiting examples of preferred cations including sodium, potassium, ammonium, and mixtures thereof, and x is an integer of at least about 7, preferably at least about 9, and y is an integer of at least 8, preferably at least about 9; d) $C_{10}$-$C_{18}$ alkyl alkoxy sulfates ($AE_zS$) wherein preferably z is from 1-30; e) $C_{10}$-$C_{18}$ alkyl alkoxy carboxylates preferably comprising 1-5 ethoxy units; f) mid-chain branched alkyl sulfates as discussed in U.S. Pat. Nos. 6,020,303 and 6,060,443; g) mid-chain branched alkyl alkoxy sulfates as discussed in U.S. Pat. Nos. 6,008,181 and 6,020,303; h) modified alkylbenzene sulfonate (MLAS) as discussed in WO 99/05243, WO 99/05242, WO 99/05244, WO 99/05082, WO 99/05084, WO 99/05241, WO 99/07656, WO 00/23549, and WO 00/23548; i) methyl ester sulfonate (MES); and j) alpha-olefin sulfonate (AOS).

Suitable nonionic surfactants useful herein may comprise any of the conventional nonionic surfactant types typically used in liquid detergent products. These include, for example, alkoxylated fatty alcohols and amine oxide surfactants. Preferred for use in the liquid detergent products herein are those nonionic surfactants which are normally liquid. Suitable nonionic surfactants for use herein include the alcohol alkoxylate nonionic surfactants. Alcohol alkoxylates are materials which correspond to the general formula: $R^1(C_mH_{2m}O)_pOH$ wherein $R^1$ is a $C_8$-$C_{16}$ alkyl group, m is from 2 to 4, and p ranges from about 2 to 12. Preferably $R^1$ is an alkyl group which may be primary or secondary and that contains from about 9 to about 15 carbon atoms, more preferably from about 10 to about 14 carbon atoms. In one embodiment, the alkoxylated fatty alcohols may also be ethoxylated materials that contain from about 2 to about 12 ethylene oxide moieties per molecule, more preferably from about 3 to about 10 ethylene oxide moieties per molecule.

The alkoxylated fatty alcohol materials useful in the liquid detergent compositions herein will frequently have a hydrophilic-lipophilic balance (HLB) which ranges from about 3 to 17. More preferably, the HLB of this material will range from about 6 to 15, most preferably from about 8 to 15. Suitable alkoxylated fatty alcohol nonionic surfactants have been marketed under the tradename NEODOL® by the Shell Chemical Company.

Another suitable type of nonionic surfactant useful herein comprises the amine oxide surfactants. Amine oxides are materials which are often referred to in the art as "semi-polar" nonionics. Amine oxides have the formula: $R^2(EO)_f(PO)_g(BO)_hN(O)(CH_2R^3)_2.qH_2O$. In this formula, $R^2$ is a relatively long-chain alkyl moiety which can be saturated or unsaturated, linear or branched, and can contain from 8 to 20, preferably from 10 to 16 carbon atoms, and is more preferably a $C_{12}$-$C_{16}$ primary alkyl. $R^3$ is a short-chain moiety, preferably selected from hydrogen, methyl and —$CH_2OH$. When f+g+h is different from 0, EO is ethyleneoxy, PO is propyleneneoxy and BO is butyleneoxy. Exemplary amine oxide surfactants may be illustrated by $C_{12}$-$C_{14}$ alkyldimethyl amine oxide.

Non-limiting examples of nonionic surfactants include: a) $C_{12}$-$C_{18}$ alkyl ethoxylates, such as, NEODOL® nonionic surfactants from Shell; b) $C_6$-$C_{12}$ alkyl phenol alkoxylates wherein the alkoxylate units are a mixture of ethyleneoxy and propyleneoxy units; c) $C_{12}$-$C_{18}$ alcohol and $C_6$-$C_{12}$ alkyl phenol condensates with ethylene oxide/propylene oxide block polymers such as PLURONIC® from BASF; d) $C_{14}$-$C_{22}$ mid-chain branched alcohols ("BA") as discussed in U.S. Pat. No. 6,150,322; e) $C_{14}$-$C_{22}$ mid-chain branched alkyl alkoxylates ("$BAE_z$"), wherein z is 1-30, as discussed in U.S. Pat. Nos. 6,153,577; 6,020,303; and 6,093,856; f) alkyl-polysaccharides as discussed in U.S. Pat. No. 4,565,647; specifically alkylpolyglycosides as discussed in U.S. Pat. Nos. 4,483,780 and 4,483,779; g) Polyhydroxy fatty acid amides as discussed in U.S. Pat. No. 5,332,528, WO 92/06162, WO 93/19146, WO 93/19038, and WO 94/09099; and h) ether capped poly (oxyalkylated) alcohol surfactants as discussed in U.S. Pat. No. 6,482,994 and WO 01/42408.

In certain embodiments of the laundry detergent compositions herein, the detersive surfactant component may comprise combinations of anionic and nonionic surfactant materials. When this is the case, the weight ratio of anionic to nonionic will typically range from 10:90 to 90:10, more typically from 30:70 to 70:30.

Cationic surfactants are known in the art and non-limiting examples of these include quaternary ammonium surfactants, which can have up to 26 carbon atoms. Additional examples include a) alkoxylate quaternary ammonium ("AQA") surfactants as discussed in U.S. Pat. No. 6,136,769; b) dimethyl hydroxyethyl quaternary ammonium as discussed in U.S. Pat. No. 6,004,922; c) polyamine cationic surfactants as discussed in WO 98/35002, WO 98/35003, WO 98/35004, WO 98/35005, and WO 98/35006; d) cationic ester surfactants as discussed in U.S. Pat. Nos. 4,228,042; 4,239,660; 4,260,529; and 6,022,844; and e) amino surfactants as discussed in U.S. Pat. No. 6,221,825 and WO 00/47708, such as amido propyldimethyl amine ("APA").

Non-limiting examples of zwitterionic surfactants include: derivatives of secondary and tertiary amines, derivatives of heterocyclic secondary and tertiary amines, or derivatives of quaternary ammonium, quaternary phosphonium or tertiary sulfonium compounds. See U.S. Pat. No. 3,929,678 at column 19, line 38 through column 22, line 48, for examples of zwitterionic surfactants; betaines, including alkyl dimethyl betaine and cocodimethyl amidopropyl betaine, $C_8$ to $C_{18}$ (for example from $C_{12}$ to $C_{18}$) amine oxides and sulfo and hydroxy betaines, such as N-alkyl-N,N-dimethylammino-1-propane sulfonate where the alkyl group can be $C_8$ to $C_{18}$ and in certain embodiments from $C_{10}$ to $C_{14}$.

Non-limiting examples of ampholytic surfactants include: aliphatic derivatives of secondary or tertiary amines, or aliphatic derivatives of heterocyclic secondary and tertiary amines in which the aliphatic radical can be straight- or branched-chain. One of the aliphatic substituents may contain at least about 8 carbon atoms, for example from about 8 to about 18 carbon atoms, and at least one contains an anionic water-solubilizing group, e.g. carboxy, sulfonate, sulfate. See U.S. Pat. No. 3,929,678 at column 19, lines 18-35, for suitable examples of ampholytic surfactants.

Nonlimiting examples of surfactant systems include the conventional $C_{11}$-$C_{18}$ alkyl benzene sulfonates ("LAS") and primary, branched-chain and random $C_{10}$-$C_{20}$ alkyl sulfates ("AS"), the $C_{10}$-$C_{18}$ secondary (2,3)-alkyl sulfates of the formula $CH_3(CH_2)_x(CHOSO_3^-M^+)CH_3$ and $CH_3(CH_2)_y(CHOSO_3^-M^+)CH_2CH_3$ where x and (y+1) are integers of at least about 7, in other embodiments at least about 9, and M is a water-solubilizing cation, especially sodium, unsaturated sulfates such as oleyl sulfate, the $C_{10}$-$C_{18}$ alkyl alkoxy sulfates ("$AE_zS$"; especially EO 1-7 ethoxy sulfates), $C_{10}$-$C_{18}$ alkyl alkoxy carboxylates (especially the EO 1-5 ethoxycarboxylates), the $C_{10}$-$C_{18}$ glycerol ethers, the $C_{10}$-$C_{18}$ alkyl polyglycosides and their corresponding sulfated polyglycosides, and $C_{12}$-$C_{18}$ alpha-sulfonated fatty acid esters. If desired, the conventional nonionic and amphoteric surfactants such as the $C_{12}$-$C_{18}$ alkyl ethoxylates ("AE") including the narrow peaked alkyl ethoxylates and $C_6$-$C_{12}$ alkyl phenol alkoxylates (especially ethoxylates and mixed ethoxy/propoxyates), $C_{12}$-$C_{18}$ betaines and sulfobetaines ("sultaines"), $C_{10}$-$C_{18}$ amine oxides, and the like, can also be included in the surfactant system. The $C_{10}$-$C_{18}$ N-alkyl polyhydroxy fatty acid amides can also be used. See WO 92/06154. Other sugar-derived surfactants include the N-alkoxy polyhydroxy fatty acid amides, such as $C_{10}$-$C_{18}$ N-(3-methoxypropyl) glucamide. The N-propyl through N-hexyl $C_{12}$-$C_{18}$ glucamides can be used for low sudsing. $C_{10}$-$C_{20}$ conventional soaps may also be used. If high sudsing is desired, the branched-chain $C_{10}$-$C_{16}$ soaps may be used. Mixtures of anionic and nonionic surfactants are especially useful. Other conventional useful surfactants are listed in standard texts.

The detergent composition may also, and in certain embodiments does, include a detergent builder. Builders are generally selected from the various water-soluble, alkali metal, ammonium or substituted ammonium phosphates, polyphosphates, phosphonates, polyphosphonates, carbonates, silicates, borates, polyhydroxy sulfonates, polyacetates, carboxylates, and polycarboxylates. Specific embodiments include the alkali metal, especially sodium, salts of the above. Other embodiments for use herein are the phosphates, carbonates, silicates, $C_{10}$-$C_{18}$ fatty acids, polycarboxylates, and mixtures thereof. Still other embodiments include sodium tripolyphosphate, tetrasodium pyrophosphate, citrate, tartrate mono- and di-succinates, sodium silicate, and mixtures thereof.

Specific examples of inorganic phosphate builders include sodium and potassium tripolyphosphate, pyrophosphate, polymeric metaphosphate having a degree of polymerization of from about 6 to 21, and orthophosphates. Examples of polyphosphonate builders are the sodium and potassium salts of ethylene diphosphonic acid, the sodium and potassium salts of ethane 1-hydroxy-1,1-diphosphonic acid and the sodium and potassium salts of ethane, 1,1,2-triphosphonic acid. Other phosphorus builder compounds are disclosed in U.S. Pat. Nos. 3,159,581; 3,213,030; 3,422,021; 3,422,137; 3,400,176 and 3,400,148. Examples of non-phosphorus, inorganic builders are sodium and potassium carbonate, bicarbonate, sesquicarbonate, tetraborate decahydrate, and silicates having a weight ratio of $SiO_2$ to alkali metal oxide of from about 0.5 to about 4.0, or in other embodiments from about 1.0 to about 2.4. Water-soluble, nonphosphorus organic builders useful herein include the various alkali metal, ammonium and substituted ammonium polyacetates, carboxylates, polycarboxylates and polyhydroxy sulfonates. Examples of polyacetate and polycarboxylate builders include the sodium, potassium, lithium, ammonium and substituted ammonium salts of ethylene diamine tetraacetic acid, nitrilotriacetic acid, oxydisuccinic acid, mellitic acid, benzene polycarboxylic acids, and citric acid.

Polymeric polycarboxylate builders are set forth in U.S. Pat. No. 3,308,067. Such materials include the water-soluble salts of homo- and copolymers of aliphatic carboxylic acids such as maleic acid, itaconic acid, mesaconic acid, fumaric acid, aconitic acid, citraconic acid and methylenemalonic acid. Some of these materials are useful as the water-soluble anionic polymer as hereinafter described, but only if in intimate admixture with the non-soap anionic surfactant. Other suitable polycarboxylates for use herein are the polyacetal carboxylates described in U.S. Pat. Nos. 4,144,226 and 4,246,495.

Water-soluble silicate solids represented by the formula $SiO_2.M_2O$, M being an alkali metal, and having a $SiO_2:M_2O$ weight ratio of from about 0.5 to about 4.0, are useful salts in the detergent granules of the invention at levels of from about 2% to about 15% on an anhydrous weight basis. Anhydrous or hydrated particulate silicate may also be utilized in certain embodiments.

Any number of additional ingredients can also be included as components in the granular detergent composition. These include other detergency builders, bleaches, bleach activators, suds boosters or suds suppressors, anti-tarnish and anti-corrosion agents, soil suspending agents, soil release agents, germicides, pH adjusting agents, non-builder alkalinity sources, chelating agents, smectite clays, enzyme-stabilizing agents and perfumes. See, for example, U.S. Pat. No. 3,936,537.

Bleaching agents and activators are described in U.S. Pat. Nos. 4,412,934 and 4,483,781. Chelating agents are described in U.S. Pat. No. 4,663,071, from Column 17, line 54 through Column 18, line 68. Suds modifiers are also optional ingredients and are described in U.S. Pat. Nos. 3,933,672 and 4,136,045. Suitable smectite clays for use herein are described in U.S. Pat. No. 4,762,645 at Column 6, line 3 through Column 7, line 24. Suitable additional detergency builders for use herein are enumerated in the U.S. Pat. No. 3,936,537 at Column 13, line 54 through Column 16, line 16, and in U.S. Pat. No. 4,663,071.

Adjunct Materials

While not essential for the purposes of the present disclosure, the non-limiting list of adjuncts illustrated hereinafter may be suitable for use in the detergent compositions and may be desirably incorporated in certain embodiments, for example to assist or enhance performance, for treatment of the substrate to be cleaned, or to modify the aesthetics of the composition as is the case with perfumes, colorants, dyes or the like. It is understood that such adjuncts are in addition to the components that were previously listed for any particular embodiment. The total amount of such adjuncts may range from about 0.1% to about 50%, or even from about 1% to about 30%, by weight of the detergent composition.

The precise nature of these additional components, and levels of incorporation thereof, will depend on the physical form of the composition and the nature of the operation for which it is to be used. Suitable adjunct materials include, but are not limited to, polymers, for example cationic polymers, surfactants, builders, chelating agents, dye transfer inhibiting agents, dispersants, enzyme stabilizers, catalytic materials, bleach activators, polymeric dispersing agents, clay soil removal/anti-redeposition agents, brighteners, suds suppressors, dyes, additional perfume and perfume delivery systems, structure elasticizing agents, fabric softeners, carriers, hydrotropes, processing aids and/or pigments. In addition to the disclosure below, suitable examples of such other adjuncts and levels of use are found in U.S. Pat. Nos. 5,576,282, 6,306,812 B1 and 6,326,348 B1.

As stated, the adjunct ingredients are not essential to the detergent compositions described herein. Thus, certain embodiments of the detergent compositions may not contain one or more of the following adjuncts materials: bleach activators, surfactants, builders, chelating agents, dye transfer inhibiting agents, dispersants, enzyme stabilizers, catalytic metal complexes, polymeric dispersing agents, clay and soil removal/anti-redeposition agents, brighteners, suds suppressors, dyes, additional perfumes and perfume delivery systems, structure elasticizing agents, fabric softeners, carriers, hydrotropes, processing aids and/or pigments. However, when one or more adjuncts are present, such one or more adjuncts may be present as detailed herein:

Builders—The compositions of the present invention can comprise one or more detergent builders or builder systems. When present, the compositions will typically comprise at least about 1% builder, or from about 5% or 10% to about 80%, 50%, or even 30% by weight, of said builder. Builders include, but are not limited to, the alkali metal, ammonium and alkanolammonium salts of polyphosphates, alkali metal silicates, alkaline earth and alkali metal carbonates, aluminosilicate builders polycarboxylate compounds, ether hydroxypolycarboxylates, copolymers of maleic anhydride with ethylene or vinyl methyl ether, 1,3,5-trihydroxybenzene-2,4,6-trisulphonic acid, and carboxymethyl-oxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Dye Transfer Inhibiting Agents—The compositions of the present invention may also include one or more dye transfer inhibiting agents. Suitable polymeric dye transfer inhibiting agents include, but are not limited to, polyvinylpyrrolidone polymers, polyamine N-oxide polymers, copolymers of N-vinylpyrrolidone and N-vinylimidazole, polyvinyloxazolidones and polyvinylimidazoles or mixtures thereof. When present in the compositions herein, the dye transfer inhibiting agents are present at levels from about 0.0001%, from about 0.01%, from about 0.05% by weight of the cleaning compositions to about 10%, about 2%, or even about 1% by weight of the cleaning compositions.

Dispersants—The compositions of the present invention can also contain dispersants. Suitable water-soluble organic materials are the homo- or co-polymeric acids or their salts, in which the polycarboxylic acid may comprise at least two carboxyl radicals separated from each other by not more than two carbon atoms.

Processes of Making Detergent Compositions

The detergent compositions of the present invention can be formulated into any suitable form and prepared by any process chosen by the formulator, non-limiting examples of which are described in U.S. Pat. Nos. 5,879,584; 5,691,297; 5,574,005; 5,569,645; 5,565,422; 5,516,448; 5,489,392; and 5,486,303.

In one aspect, the detergent compositions disclosed herein may be prepared by combining the components thereof in any convenient order and by mixing, e.g., agitating, the resulting component combination to form a phase stable liquid detergent composition. In one aspect, a liquid matrix is formed containing at least a major proportion, or even substantially all, of the liquid components, e.g., nonionic surfactant, the non-surface active liquid carriers and other optional liquid components, with the liquid components being thoroughly admixed by imparting shear agitation to this liquid combination. For example, rapid stirring with a mechanical stirrer may usefully be employed. While shear agitation is maintained, the Tiron (1,2-dihydroxybenzye-3,5-disulfonic acid) and substantially all of any anionic surfactant and the solid ingredients can be added. Agitation of the mixture is continued, and if necessary, can be increased at this point to form a solution or a uniform dispersion of insoluble solid phase particulates within the liquid phase. After some or all of the solid-form materials have been added to this agitated mixture, particles of any enzyme material to be included, e.g., enzyme prills, are incorporated. As a variation of the composition preparation procedure described above, one or more of the solid components may be added to the agitated mixture as a solution or slurry of particles premixed with a minor portion of one or more of the liquid components. After addition of all of the composition components, agitation of the mixture is continued for a period of time sufficient to form compositions having the requisite viscosity and phase stability characteristics. Frequently this will involve agitation for a period of from about 30 to 60 minutes.

Methods of Using Detergent Compositions

The detergent compositions of the present disclosure may be used to clean or treat a fabric. Typically at least a portion of the fabric is contacted with an embodiment of the aforementioned detergent compositions, in neat form or diluted in a liquor, for example, a wash liquor and then the fabric may be optionally washed and/or rinsed. In one aspect, a fabric is optionally washed and/or rinsed, contacted with an embodiment of the aforementioned detergent compositions and then optionally washed and/or rinsed. For purposes of the present invention, washing includes but is not limited to, scrubbing, and mechanical agitation. The fabric may comprise most any fabric capable of being laundered or treated.

The detergent compositions of the present disclosure may be used to form aqueous washing solutions for use in the laundering of fabrics. Generally, an effective amount of such compositions is added to water, for example in a conventional fabric laundering automatic washing machine or by a hand washing method, to form such aqueous laundering solutions. The aqueous washing solution so formed is then contacted, preferably under agitation, with the fabrics to be laundered therewith. An effective amount of the detergent composition, such as the HDL detergent compositions of the present disclosure, may be added to water to form aqueous laundering solutions that may comprise from about 500 to about 7,000 ppm or even from about 1,000 to about 3,000 pm of detergent composition.

The following representative examples are included for purposes of illustration and not limitation.

EXAMPLES

Example 1

In this Example, the molar ratio of DTPA to calcium ion at which a good balance between Tiron (1,2-dihydroxybenzye-3,5-disulfonic acid) color control and enzyme stability is determined. The stability of NATALASE® amylase enzyme at various concentrations of calcium ion and various concentrations of DTPA is determined.

To a sample formulation of commercially available HDL liquid detergent is added 5 ppm of $Fe^{3+}$ and 1% (wt) of Tiron (1,2-dihydroxybenzye-3,5-disulfonic acid). Varying concentrations of DTPA (pentasodium salt) and calcium ion (in the form of calcium formate) are added to the detergent mixture to form a 3×3 matrix of nine samples and the solution stirred with mechanical stirring. The color and enzyme stability is measured. Enzyme stability is determined at 32° C. over 21 days using the Infinity™ reagent utilizing ethylidene-pNP-G7 as substrate (commercially available from Thermo Scientific, Waltham, Mass.). The stability of the enzyme under various experimental conditions is presented in Table 1. As can be seen in Table 1, at enzyme stability is greatest at higher calcium ion concentrations and as the DTPA level increases, the enzyme stability decreases. FIG. 2 displays the color observed for detergent the samples in the 3×3 sample matrix. Unacceptable red color levels are observed at low concentrations of DTPA and high concentrations of calcium ion, for example at 0.30% DTPA and 0.075% calcium, at 0.20% DTPA and 0.075% calcium, and at 0.20% DTPA and 0.050% calcium. In addition, low levels of enzyme stability are observed at high concentrations of DTPA and low levels of calcium, for example at 0.40% DTPA and 0.050% calcium, at 0.40% DTPA and 0.025% calcium, and at 0.30% DTPA and 0.025% calcium. Table 1 illustrates that at a DTPA to calcium ion molar ratio of about 1.2:1 to about 1.6:1, a balance between good Tiron (1,2-dihydroxybenzye-3,5-disulfonic acid) color control (i.e., no noticeable red color formed from Tiron (1,2-dihydroxybenzye-3,5-disulfonic acid)/iron complex formation) and good enzyme formula stability is achieved, for example at 0.40% DTPA and 0.075% calcium, at 0.30% DTPA and 0.050% calcium, and at 0.20% DTPA and 0.025% calcium.

TABLE 1

DTPA/Calcium Ion Ratio Impact on Enzyme Stability

| | DTPA Level (wt %) | | |
|---|---|---|---|
| | 0.40% | 0.30% | 0.20% |
| $Ca^{2+}$ Level (wt %) | Enzyme Stability and Detergent Color | | |
| 0.075% | 82% | 90% (red) | 92% (red) |
| 0.050% | 62% | 72% | 89% (red) |
| 0.025% | 51% | 56% | 62% |

Example 2

In this example, the color reversibility of iron/Tiron (1,2-dihydroxybenzye-3,5-disulfonic acid) complexes is demonstrated. Red color formation is demonstrated by the addition of excess iron to a detergent composition comprising Tiron (1,2-dihydroxybenzye-3,5-disulfonic acid), calcium formate, and DTPA and the red color is then eliminated/reversed by addition of DTPA.

To a sample formula of a commercial HDL liquid detergent containing calcium is added 1% (wt) of Tiron (1,2-dihydroxybenzye-3,5-disulfonic acid), sufficient $Fe^{3+}$ to form red coloration, and insufficient levels iron binding chelant (e.g., DTPA) to mitigate color formation by the HDL sample. For example, 1% Tiron (1,2-dihydroxybenzye-3,5-disulfonic acid), 10 ppm $Fe^{3+}$, and low levels of DTPA are added to an HDL formulation to achieve a DTPA:Calcium molar ration below 1.0. The resulting red HDL sample is them titrated with a DTPA solution to until the DTPA:Calcium molar ration exceeds at least 1.05, and the mixture is mechanically stirred for at least 15 minutes. The resulting HDL sample color turns from red back to yellow indicating reversal of the Tiron (1,2-dihydroxybenzye-3,5-disulfonic acid)/iron chelate formation.

Example 3

In this Example, liquid detergent compositions are formed, an iron standard is added and the spectroscopic characteristics of the resulting solution are measured.

The detergent composition was made using the following protocol. To a 7.6 L heavy duty plastic bucket is added 2,122 g of a blend of alkyl ethoxy sulfate ("AES") paste (technical grade, ~50% wt/wt). The following materials are added in order to the mixture while stirring with an overhead stirrer (IKA model DZM.N RW20) to ensure adequate mixing: 660 g of a branched alkyl sulfate paste (~50% wt/wt); 100 g of a neat amine alcohol; 50 g diethylene glycol; 160 g fluorescent brightener; 24.5 g of a DTPA solution (VERSENEX® 80, commercially available from the Dow Chemical Company, Midland, Mich.) was added to ensure dissolution of the calcium formate; 144 g of a LAS paste (97% active wt/wt); 300 g citric acid (50% active); 12.5 g calcium formate (10% wt/wt active); 100 g $C_{12}$-$C_{18}$ fatty acid; 400 g borax premix; 319 g Tiron (1,2-dihydroxybenzye-3,5-disulfonic acid) dissolved in water to a 20% wt/wt activity; and 480 g distilled water.

The resulting liquid detergent composition will have the following characteristics: a $Ca^{2+}$ concentration of no greater than 0.00630 Molar; no Fe ion contamination or measurable Fe ion concentration; the detergent composition contains 1% wt/wt of Tiron (1,2-dihydroxybenzye-3,5-disulfonic acid); the density of the detergent composition will be 1.09+/−0.1 g/mL; and the pH of the detergent composition is from 7 to 9, and in certain embodiments the pH will be 8.

The detergent composition is divided into twenty-five (25) samples weighing 195.0 g (182.1 mL) each. The samples are divided into a five by five matrix (five groups of five samples) and an additional amount of DTPA solution (VERSENEX® 80) is added to the samples in each group as set forth in Table 2. The DTPA:$Ca^{2+}$ ratio is calculated for each sample group. A standard solution containing 1000 ppm of Fe ions is added (0.2 mL, 0.5 mL, 1.0 mL, 2.0 mL, and 3.0 mL of Fe standard) to samples in each group to provide a 1.0 ppm ($3.58\times10^{-6}$ moles), 2.5 ppm ($8.95\times10^{-6}$ moles), 5.0 ppm ($1.79\times10^{-5}$ moles), 10.0 ppm ($3.58\times10^{-5}$ moles), and 15.0 ppm ($5.37\times10^{-5}$ moles) Fe ion concentration, respectively, for the samples in each sample group.

TABLE 2

Sample Composition

| Sample Group | DTPA Soln Added | DTPA:$Ca^{2+}$ Ratio |
|---|---|---|
| 1 | 0.613 g | 1.1:1 |
| 2 | 0.901 g | 1.3:1 |
| 3 | 1.109 g | 1.5:1 |
| 4 | 1.479 g | 1.7:1 |
| 5 | 1.912 g | 2.0:1 |

The color of each of the resulting 25 samples are displayed in FIG. 1. The resulting samples are examined by spectroscopic methods to determine the level of the red color developed from the Tiron (1,2-dihydroxybenzye-3,5-disulfonic acid)/Fe ion chelate complex. The sample color are measured using Lovibond color scale, the Hunter L.a.b (CIE) color scale, the APHA color scale, the Saybolt color scale, and the Gardner color scale. The spectroscopic results are set forth in Table 3.

Acceptable red color levels are observed in all samples in Sample Groups 3-5, in samples having 5 ppm Fe or less in Sample Group 2, and in the sample having 1 ppm Fe in Sample Group 1.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

TABLE 3

Spectroscopic Measurement of Color of Detergent Samples

| SAMPLE GROUP | Fe (ppm) | Lovibond Red | Lovibond Yellow | Hunter L | Hunter a | Hunter b | APHA | Saybolt | Gardner |
|---|---|---|---|---|---|---|---|---|---|
| 1 | 1.0 | 0.8 | 2.4 | 89.2 | −4.5 | 24.4 | 95 | 11 | 4.3 |
| | 2.5 | 1.2 | 2.7 | 86.6 | −1.8 | 25.4 | 107 | 9 | 4.7 |
| | 5.0 | 1.9 | 3.2 | 82.0 | 3.1 | 26.6 | 127 | 7 | 5.2 |
| | 10.0 | 3.4 | 4.7 | 72.7 | 12.1 | 28.3 | 177 | 1 | 6.1 |
| | 15.0 | 5.2 | 6.5 | 64.7 | 20.1 | 29.1 | 240 | −20 | 6.8 |
| 2 | 1.0 | 0.5 | 2.1 | 90.9 | −6.6 | 23.8 | 88 | 12 | 4.1 |
| | 2.5 | 0.7 | 2.4 | 90.5 | −5.9 | 24.9 | 94 | 11 | 4.3 |
| | 5.0 | 0.9 | 2.6 | 89.1 | −4.7 | 25.9 | 103 | 10 | 4.7 |
| | 10.0 | 1.4 | 3.2 | 85.6 | −1.6 | 27.6 | 122 | 7 | 5.1 |
| | 15.0 | 1.9 | 3.8 | 82.1 | 1.8 | 29.1 | 143 | 5 | 5.6 |
| 3 | 1.0 | 0.4 | 2.1 | 91.8 | −7.2 | 24.3 | 89 | 12 | 4.2 |
| | 2.5 | 0.5 | 2.3 | 91.3 | −6.9 | 24.9 | 93 | 11 | 4.3 |
| | 5.0 | 0.6 | 2.5 | 90.3 | −6.4 | 25.7 | 99 | 10 | 4.5 |
| | 10.0 | 0.9 | 2.7 | 88.9 | −5.4 | 27.3 | 110 | 9 | 4.8 |
| | 15.0 | 1.0 | 3.2 | 87.8 | −4.4 | 28.8 | 123 | 7 | 5.1 |
| 4 | 1.0 | 0.4 | 2.1 | 91.2 | −7.2 | 24.1 | 89 | 12 | 4.2 |
| | 2.5 | 0.5 | 2.3 | 91.3 | −7.1 | 24.9 | 93 | 11 | 4.3 |
| | 5.0 | 0.5 | 2.4 | 90.8 | −6.8 | 25.8 | 98 | 10 | 4.5 |
| | 10.0 | 0.7 | 2.7 | 89.3 | −6.3 | 27.2 | 109 | 9 | 4.8 |
| | 15.0 | 0.9 | 3.1 | 88.4 | −5.8 | 28.7 | 119 | 7 | 5.0 |
| 5 | 1.0 | 0.5 | 2.2 | 90.8 | −7.1 | 24.4 | 90 | 12 | 4.2 |
| | 2.5 | 0.5 | 2.4 | 90.4 | −6.9 | 25.2 | 95 | 11 | 4.4 |

TABLE 3-continued

| Spectroscopic Measurement of Color of Detergent Samples | | | | | | | | | |
|---|---|---|---|---|---|---|---|---|---|
| SAMPLE | Fe | Lovibond | Lovibond | Hunter | | | | | |
| GROUP | (ppm) | Red | Yellow | L | a | b | APHA | Saybolt | Gardner |
| | 5.0 | 0.6 | 2.5 | 90.4 | −6.8 | 25.9 | 100 | 10 | 4.6 |
| | 10.0 | 0.7 | 2.8 | 89.1 | −6.3 | 27.6 | 111 | 9 | 4.9 |
| | 15.0 | 0.9 | 3.1 | 88.8 | −6.0 | 29.1 | 121 | 7 | 5.1 |

What is claimed is:

1. A detergent composition comprising:

a) from about 5% to about 90%, by weight of the composition, of a surfactant;

b) from about 0.1% to about 50%, by weight of the composition, of an adjunct material, said adjunct material selected from the group consisting of polymers, builders, additional chelating agents, dye transfer inhibiting agents, dispersants, enzyme stabilizers, catalytic materials, bleach activators, polymeric dispersing agents, clay soil removal/anti-redeposition agents, brighteners, suds suppressors, dyes, additional perfume and perfume delivery systems, structure elasticizing agents, fabric softeners, carriers, hydrotropes, processing aids, pigments, and mixtures thereof;

c) Tiron (1,2-dihydroxybenzene-3,5-disulfonic acid);

d) at least one calcium salt; and e) a ligand capable of chelating to ferric iron, wherein the ligand is selected from the group consisting of DTPA, DTPMP, and mixtures thereof, has a binding constant for ferric iron of at least $10^{21}$ $mol^{-1}$, and wherein when the ligand complexes with ferric iron, a ferric iron/ligand complex forms that does not have a red color; and wherein the detergent composition has a molar ratio of ligand to $Ca^{2+}$ from the calcium salt ranging from about 1.05:1 to about 1.8:1.

2. The detergent composition of claim 1, wherein the ligand has a binding constant for ferric iron ranging from about $10^{26}$ $mol^{-1}$ to about $10^{28}$ $mol^{-1}$.

3. The detergent composition of claim 1, wherein the ligand is DTPA.

4. The detergent composition of claim 1, wherein the detergent composition has a red colorimetric value selected from the group consisting of a Hunter "a" value of less than −2, a Lovibond red value of less than less than 1.0, an APHA color value of less than 110, a Saybolt color value of greater than 7.0, and a Gardner color value of less than 5.0.

5. A detergent composition comprising:

a) from about 5% to about 90%, by weight of the composition, of a surfactant;

b) from about 0.1% to about 50%, by weight of the composition, of an adjunct material, said adjunct material selected from the group consisting of polymers, builders, additional chelating agents, dye transfer inhibiting agents, dispersants, enzyme stabilizers, catalytic materials, bleach activators, polymeric dispersing agents, clay soil removal/anti-redeposition agents, brighteners, suds suppressors, dyes, additional perfume and perfume delivery systems, structure elasticizing agents, fabric softeners, carriers, hydrotropes, processing aids, pigments, and mixtures thereof;

c) Tiron (1,2-dihydroxybenzene-3,5-disulfonic acid);

d) DTPA; and e) a calcium salt; wherein the detergent composition has a molar ratio of DTPA to $Ca^{2+}$ from the calcium salt ranging from about 1.05:1 to about 1.8:1.

6. The detergent composition of claim 5, wherein the concentration of the calcium salt provides a $Ca^{2+}$ concentration ranging from about 0.1 ppm to about 500 ppm free $Ca^{2+}$.

7. The detergent composition of claim 6, wherein the concentration of the calcium salt provides a $Ca^{2+}$ concentration ranging from about 100 ppm to about 400 ppm of free $Ca^{2+}$.

8. The detergent composition of claim 1, further comprising an enzyme selected from the group consisting of proteases, amylases, hemicellulases, peroxidases, cellulases, xylanases, lipases, phospholipases, esterases, cutinases, pectinases, keratanases, reductases, oxidases, phenoloxidases, lipoxygenases, ligninases, pullulanases, tannases, pentosanases, malanases, β-glucanases, arabinosidases, hyaluronidase, chondroitinases, laccases, and combinations thereof.

9. The detergent composition of claim 5, wherein the detergent composition has a red colorimetric value selected from the group consisting of a Hunter "a" value of less than −2, a Lovibond red value of less than less than 1.0, an APHA color value of less than 110, a Saybolt color value of greater than 7.0, and a Gardner color value of less than 5.0.

10. A method for reducing the intensity of a red color in a Tiron (1,2-dihydroxybenzene-3,5-disulfonic acid) containing detergent composition comprising:

a) from about 5% to about 90%, by weight of the composition, of a surfactant;

b) from about 0.1% to about 50%, by weight of the composition, of an adjunct material, said adjunct material selected from the group consisting of polymers, builders, additional chelating agents, dye transfer inhibiting agents, dispersants, enzyme stabilizers, catalytic materials, bleach activators, polymeric dispersing agents, clay soil removal/anti-redeposition agents, brighteners, suds suppressors, dyes, additional perfume and perfume delivery systems, structure elasticizing agents, fabric softeners, carriers, hydrotropes, processing aids, pigments, and mixtures thereof;

c) Tiron (1,2-dihydroxybenzene-3,5-disulfonic acid); and d) at least one calcium salt;

the method comprising:

adding a ligand capable of chelating to ferric iron, wherein the ligand is selected from the group consisting of DTPA, DTPMP, and mixtures thereof, and has a binding constant for ferric ion of at least $10^{21}$ $mol^{-1}$; wherein the detergent composition has a molar ratio of DTPA to $Ca^{2+}$ from the calcium salt ranging from about 1.05:1 to about 1.8:1.

11. The detergent composition of claim 1, wherein the detergent composition further comprises borate.

12. The detergent composition of claim 1, wherein the concentration of the calcium salt provides a $Ca^{2+}$ concentration ranging from about 0.1 ppm to about 500 ppm free $Ca^{2+}$.

13. The detergent composition of claim 1, wherein the concentration of the calcium salt provides a $Ca^{2+}$ concentration ranging from about 100 ppm to about 400 ppm of free $Ca^{2+}$.

* * * * *